US006242062B1

(12) United States Patent
de Vries

(10) Patent No.: US 6,242,062 B1
(45) Date of Patent: Jun. 5, 2001

(54) COMBINED TURF

(75) Inventor: Hugo de Vries, Ridderkerk (NL)

(73) Assignee: Southwest Recreational Industries, Inc., Leander, TX (US)

( * ) Notice: Subject to any disclaimer, the term of this patent is extended or adjusted under 35 U.S.C. 154(b) by 0 days.

(21) Appl. No.: 09/320,776

(22) Filed: May 27, 1999

Related U.S. Application Data

(63) Continuation of application No. PCT/NL97/00659, filed on Dec. 1, 1997.

(30) Foreign Application Priority Data

Nov. 29, 1996 (NL) ..... 1004656

(51) Int. Cl.[7] ..... E01C 13/08

(52) U.S. Cl. ..... 428/17; 428/95; 428/85; 405/36; 405/38; 47/56; 139/391; 139/392

(58) Field of Search ..... 428/17, 95, 85, 428/15; 405/36, 38; 47/56, 58, 1.01 R, 1.01 F, 5.5, 9; 139/383 R, 391, 392

(56) References Cited

U.S. PATENT DOCUMENTS

| | | | |
|---|---|---|---|
| 3,315,408 | | 4/1967 | Fisher . |
| 3,940,522 | | 2/1976 | Wessells . |
| 4,044,179 | | 8/1977 | Haas, Jr. . |
| 4,337,283 | | 6/1982 | Haas, Jr. . |
| 4,389,435 | | 6/1983 | Haas, Jr. . |
| 4,444,815 | | 4/1984 | Friedrich . |
| 4,739,603 | * | 4/1988 | Butler . |
| 5,205,068 | | 4/1993 | Solomou . |
| 5,489,317 | | 2/1996 | Bergevin . |
| 5,586,408 | | 12/1996 | Bergevin . |
| 5,850,708 | | 12/1998 | Bergevin . |
| 6,094,860 | * | 8/2000 | Motz et al. . |

FOREIGN PATENT DOCUMENTS

| | | |
|---|---|---|
| 2329975 | 1/1974 | (DE) . |
| 2248911 | 4/1974 | (DE) . |
| 3703866 | 8/1988 | (DE) . |
| 0 154841 | 2/1985 | (EP) . |
| 0 174 755 A1 | 3/1986 | (EP) . |
| 0 373 282 | 6/1990 | (EP) . |
| 0 403 008 A1 | 12/1990 | (EP) . |
| 0 724 825 A1 | 8/1996 | (EP) . |
| 59-151813 | 8/1984 | (JP) . |
| 1004656 | 11/1996 | (NL) . |
| WO 92/05316 | 4/1992 | (WO) . |
| WO 94/00639 | 1/1994 | (WO) . |
| WO 98/23817 | 6/1998 | (WO) . |

* cited by examiner

*Primary Examiner*—Deborah Jones
*Assistant Examiner*—Wendy Boss
(74) *Attorney, Agent, or Firm*—Akin, Gump, Strauss, Hauer & Feld, LLP; Russell C. Scott

(57) ABSTRACT

The invention relates to a base layer for a combined synthetic and natural turf comprising a fabric of which at least a part of the weft and/or warp threads is manufactured from a biodegradable material and/or is wholly absent so that the fabric contains apertures, and synthetic turf fibers which are least partially cowoven with the fabric and of which one or both ends form synthetic grass blades. These ends only protrude from the fabric at those locations where the non-degradable warp and weft threads intersect. The base layer is used in combined synthetic and natural turfs comprising a foundation, optionally a first layer of growth substrate and a base layer according to the invention which is provided with a second layer of growth substrate in which grass plants grow. The invention further relates to a method for laying a combined turf using the base layer of the invention.

30 Claims, 4 Drawing Sheets

COMBINED TURF

This application is a continuation application of copending international application PCT/NL97/00659 filed Dec. 1, 1997, which claims priority to NL 1004656, filed Nov. 29, 1996. The patent applications are incorporated by reference herein.

FIELD OF THE INVENTION

The present invention relates to a base layer for a combined synthetic and natural turf, comprising:

a fabric formed by a plurality of mutually substantially parallel warp threads and a plurality of mutually substantially parallel weft threads intersecting the warp threads, said fabric comprising a plurality of apertures, and a plurality of synthetic grass fibers connected at least partially to the fabric, at least one of the ends of each fiber protruding outside the fabric and forming a synthetic grass blade. Such a base layer is known, for instance from WO-A-9400639.

BACKGROUND OF THE INVENTION

Up until a number of years ago a large number of sports were practiced on natural turf. Natural turf has the advantage that it is relatively soft and wounds and injuries are thereby seldom caused during falls, sliding tackles and the like. The great drawback of natural turf however is that it can deteriorate significantly in quality due to intensive use and/or weather conditions. What remains is a badly damaged field with large, bare (sand) surfaces which cannot be played on, or only with difficulty, and which have an unattractive appearance.

Synthetic grass surfaces have therefore already existed for a number of years, in particular for hockey, tennis and the like. Synthetic grass surfaces require less maintenance and withstand a more intensive use than natural turfs. However, the drawback of synthetic turf is that the frictional resistance is so high that wounds and/or injuries can be caused in the case of sliding tackles and undesired falls.

In the present application the terms "grass surface" and "turf" are used interchangeably.

Therefore a hybrid turf or combination turf has already been proposed in the above mentioned patent document WO-A-9400639, in which the advantages of both types of turf are combined. This combination turf is formed by a conventional synthetic grass surface constituting a base layer on which a layer of growth substrate is strewn. Grass seed is sown into this growth substrate, so that the crowns of the grass lay between the synthetic grass fibers and are protected thereby. The synthetic grass is formed by a backing and a great number of upright synthetic grass fibers connected therewith. The synthetic grass fibers are regularly spaced, and may be connected to the backing by tufting or weaving. The backing is perforated, so as to allow water and roots of the natural grass to pass therethrough. As backing a coarse woven material is for instance proposed, wherein apertures are formed between the warp and weft threads. It is further proposed to construct the backing from two layers, an apertured top layer carrying the synthetic fibers and a bottom layer stabilizing the top layer with the fibers and preventing the fibers from becoming unstuck during handling of the synthetic grass. The bottom layer may be made from a biodegradable material, so that this will gradually disappear after the turf has been laid, leaving only the perforated top layer with the synthetic grass fibers.

In this known combination turf the emphasis is mainly on the synthetic grass, and there is relatively little room for growing a robust natural grass turf. Furthermore, the cost of the known combination turf is relatively high.

SUMMARY OF THE INVENTION

It is therefore the object of the present invention to provide a combination turf comprising a relatively high percentage of natural grass and which may be constructed and laid for a relatively moderate cost. This is achieved according to the invention by making use for the combined synthetic and natural turf of a base layer as described above, in which the fiber ends forming the synthetic grass blades protrude from the fabric at location where the weft threads and the warp threads intersect. By forming the synthetic grass blades exclusively at the intersections of the warp and weft threads, and not at those locations where only warp threads or weft threads are present, a base layer is obtained in which there is relatively much room for arranging natural grass. Furthermore, since the synthetic grass fibers protrude from the fabric at the intersections of warp and weft threads, the loads are transmitted to the base layer at those locations where this is strongest. It is preferable to have the synthetic grass fibers woven into the fabric, whereby a very strong connection is formed.

The apertures in the base layer may be formed immediately during manufacture thereof by enlarged spaces between adjacent warp and/or weft threads, but it is also possible to form the apertures only during use of the base layer by decomposition of warp and/or weft threads made from a biodegradable material.

The above-described base layer may be arranged between two layers of growth substrate, with grass being sown in the top layer. Due to the apertures, which are present from the start or are created in the course of time by decay or decomposition of the biodegradable threads, the roots of the natural grass plants have the opportunity to grow through the base layer and to become anchored in the bottom layer of growth substrate and possibly also at least partially in the base layer. Optimal rooting hereby becomes possible while the additional strength of the remaining fabric threads and synthetic grass blades is still retained.

Alternatively, it is also possible to suffice with one layer of growth substrate which is arranged on the base layer placed on a foundation. The roots can then become anchored in the layer of growth substrate, the foundation and/or the base layer.

In particular, the present invention provides a base layer for a combined synthetic and natural turf, the base layer comprising: a fabric formed by a plurality of mutually substantially parallel warp threads and a plurality of mutually substantially parallel weft threads intersecting the warp threads, said fabric comprising a plurality of apertures, and a plurality of synthetic grass fibers connected at least partially to the fabric, at least one of the ends of each fiber protruding outside the fabric and forming a synthetic grass blade, characterized in that the apertures are formed by enlarged spaces between adjacent warp and/or weft threads, and the fiber ends forming the synthetic grass blades protrude from the fabric at location where the weft threads and the warp threads intersect. In another aspect, the invention provides such a base layer further characterized in that the synthetic grass fibers are woven into the fabric.

In other embodiments, the invention provides such base layers further characterized in that the apertures are formed during use of the base layer by warp and/or weft threads made from a biodegradable material. In other embodiments, such base layers (further characterized in that the fabric is formed by a plurality of series of non-biodegradable weft threads and a plurality of series of biodegradable weft threads alternating with these series and a plurality of series of non-biodegradable warp-threads intersecting the weft threads and a plurality of series of biodegradable warp threads alternating with these series, and in that the ends of the synthetic grass fibers protrude from the fabric at the intersections of these series of non-biodegradable warp threads and non-biodegradable weft threads) are provided by the invention. In related embodiments, the invention provides such base layers comprising biodegradable threads further characterized in that the biodegradable material is chosen from jute, sisal, coconut fiber, or biodegradable polymers.

In another aspect, the invention provides such base layers further characterized in that the artificial grass fibers are monofilament fibers. In other related aspects, the invention provides such base layers further characterized in that at least part of the synthetic grass fibers has at least one colour other than green, which, in some embodiments, may be furthered characterized in that the synthetic grass fibers having different colours form a pattern like lines of a sportsfield or a club logo.

Base layers noted previously as being provided by the invention, in some embodiments, may be further characterized in that at least part of the fabric is impregnated or coated with fertilizers. Similarly, base layers noted previously as being provided by the invention, in other related embodiments, may be furthered characterized in that at least part of the non biodegradable threads comprise melting threads.

In other embodiments, combined synthetic and natural turf, comprising a foundation, a base layer (noted previously as being provided by the invention) arranged thereon, and a layer of growth substrate in which grass plants may grow arranged on the base layer, is provided by the invention. In related embodiments, the invention provides such combined synthetic and natural turf further characterized in that the thickness of the layer of growth substrate on the base layer is chosen such that the synthetic grass blades of the base layer protrude thereabove. In related embodiments, the invention provides such combined synthetic and natural turf (the thickness of the layer of growth substrate on the base layer being chosen such that the synthetic grass blades of the base layer protrude, or do not protrude, thereabove) further characterized by a layer of growth substrate arranged between the foundation and the base layer. In other related embodiments, the invention also provides such combined synthetic and natural turf (a layer of growth substrate being arranged, or not being arranged, between the foundation and the base layer) further characterized in that the growth substrate consists of "infertile leaf mould", a mixture of sand and an organic material, or top layer mixtures applied in natural grass turfs. In additional related embodiments, the invention also provides such combined synthetic and natural turf (a layer of growth substrate consisting of, or not consisting of, "infertile leaf mould", a mixture of sand and an organic material, or top layer mixtures applied in natural grass turfs) further characterized in that the turf is used as sportsfield or as grass turf in gardens, playgrounds, (recreational) parks or golf courses.

In another aspect, the invention provides method for creating a combined turf as described in the preceding paragraph, comprising the steps of:

a. arranging a base layer as noted previously as being provided by the invention on a foundation;

b. arranging a layer of growth substrate and grass seeds sown therein over the base layer, in such manner that the synthetic grass blades rise at least partially above the layer of growth substrate, c. causing the grass seed to germinate and raising grass plants, and d. mowing the natural grass to a length which is greater than the length of the synthetic grass blades.

The invention further provides such method, further characterized in that prior to arranging the base layer on the foundation a layer of growth substrate is arranged thereon. In an additional aspect, the invention provides such method (a layer of growth substrate being arranged, or not being arranged, on the foundation prior to arranging the base layer on the foundation) furthered characterized in that the step of arranging a layer of growth substrate including grass seeds over the base layer comprises the intermediate steps of:

b1. at least partially working or strewing the growth substrate into the base layer, b2. sowing the grass seed into the growth substrate, and b3. arranging the remainder of the growth substrate over the grass seed.

BRIEF DESCRIPTION OF THE DRAWINGS

The present invention will be further elucidated on the basis of the annexed drawings in which corresponding reference numerals refer to corresponding components and in which.

DESCRIPTION OF THE PREFERRED EMBODIMENTS

Figure 1:
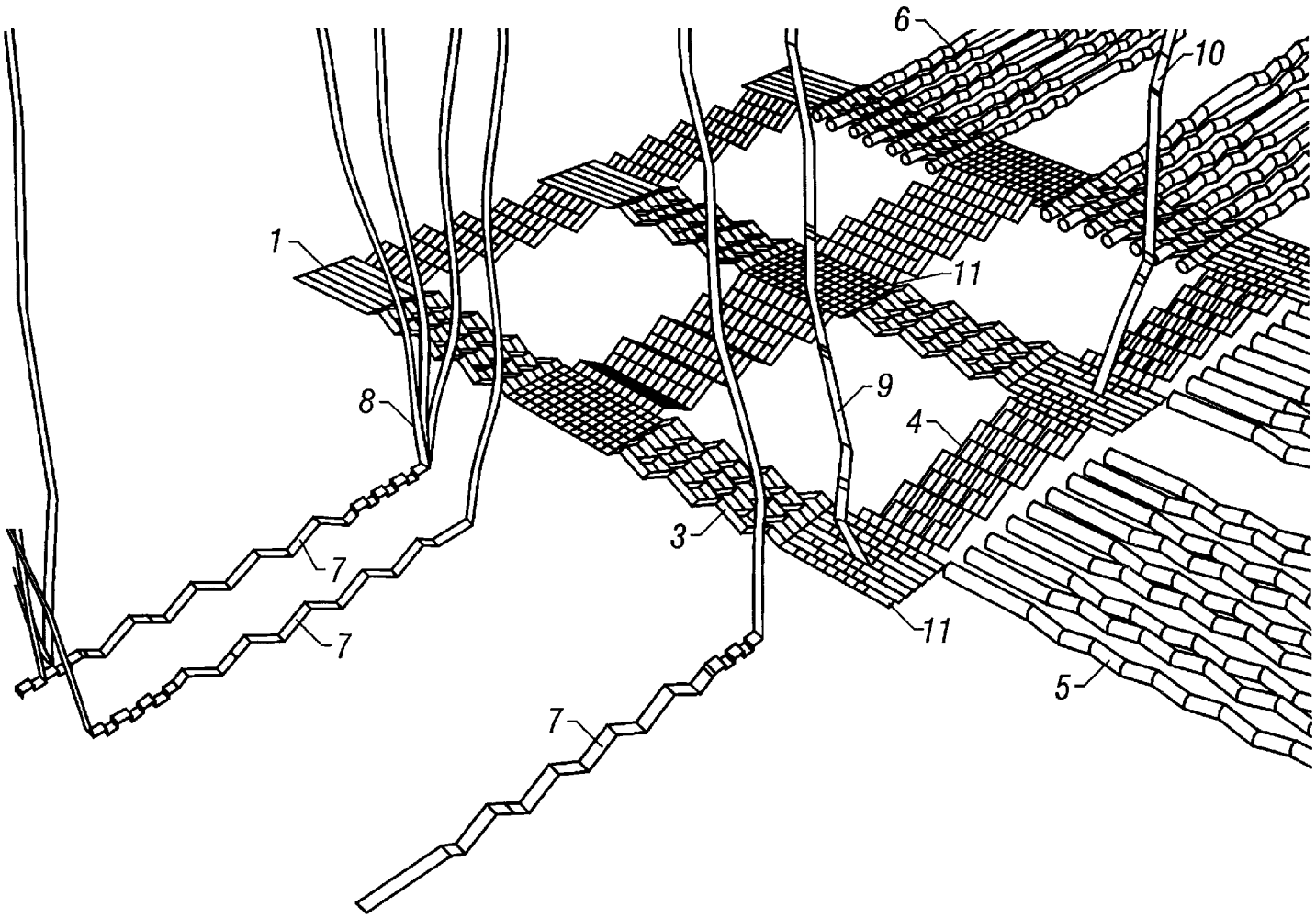
FIG. 1 shows a perspective detail view of a base layer according to the invention with separated parts.
Figure 2:
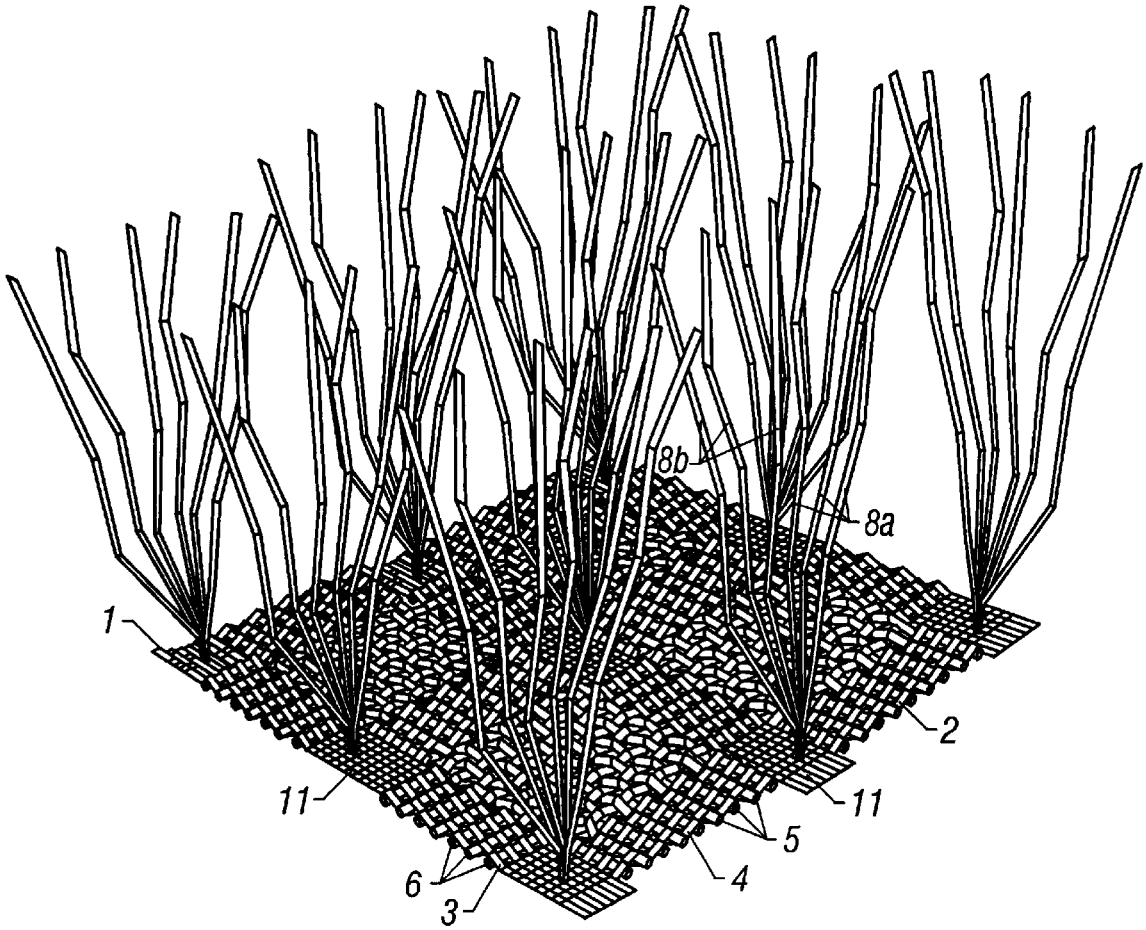
FIG. 2 shows a perspective detail view of a base layer according to the invention.

FIG. 1 and FIG. 2 show a base layer 1 consisting of a fabric 2 of series of non-degradable warp threads 3 and weft threads 4 alternating with series of biodegradable warp threads 5 and weft threads 6.

Synthetic grass fibers 7, preferably in a bundle 8, are co-woven such that the ends 9 and 10, which form grass blades, extend from the fabric at intersections 11 of non-degradable warp and weft threads. At each intersection the blades of for instance two successive bundles 8*a* and 8*b* extend outward. In an alternative embodiment of the invention, the threads 5 and 6 can be omitted, whereby apertures are already created immediately in the fabric.

Figure 3:
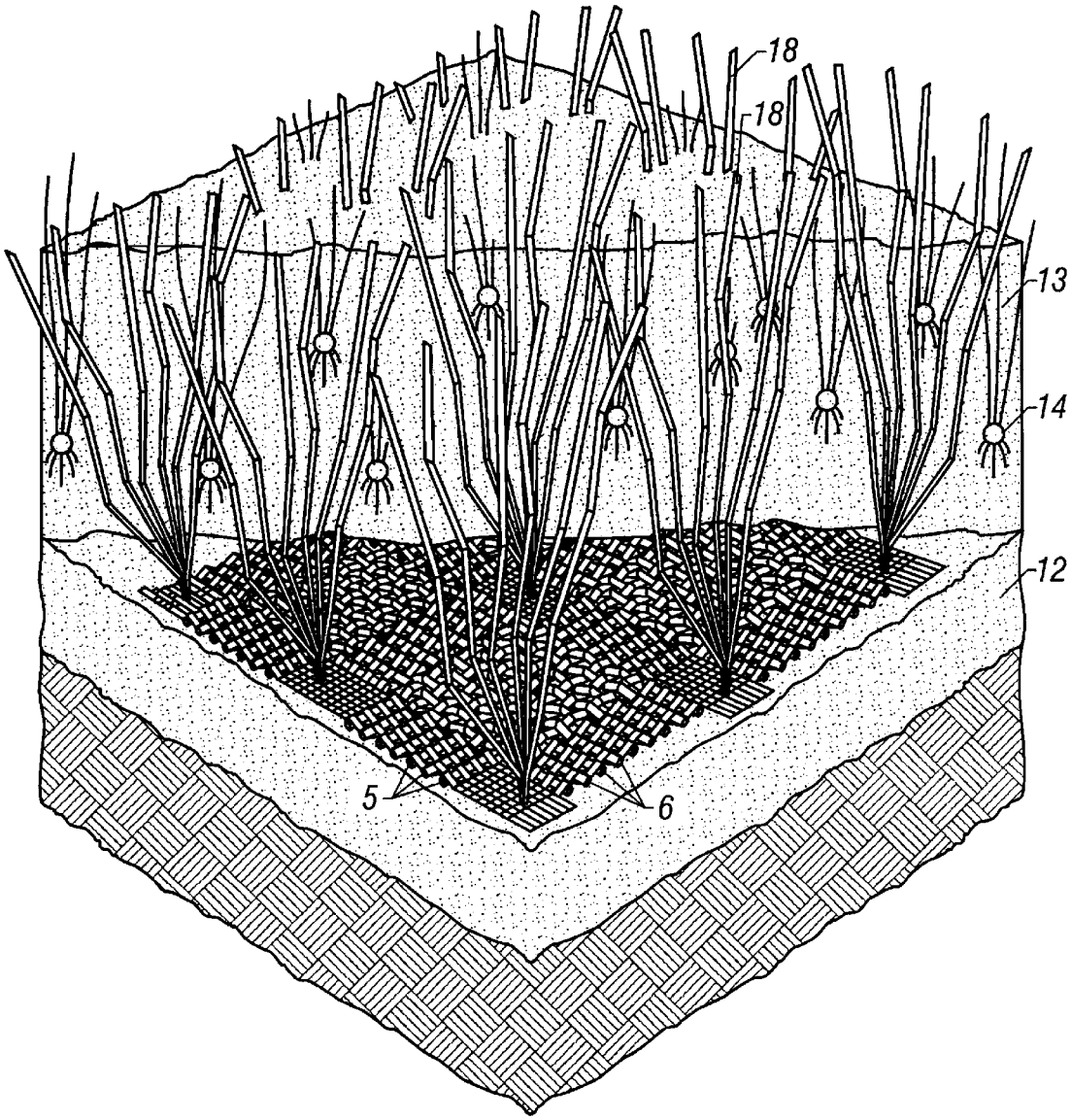
FIG. 3 is a partly broken away perspective detail view of a part of a combined turf according to the invention with grass which is just germinating.
Figure 4:
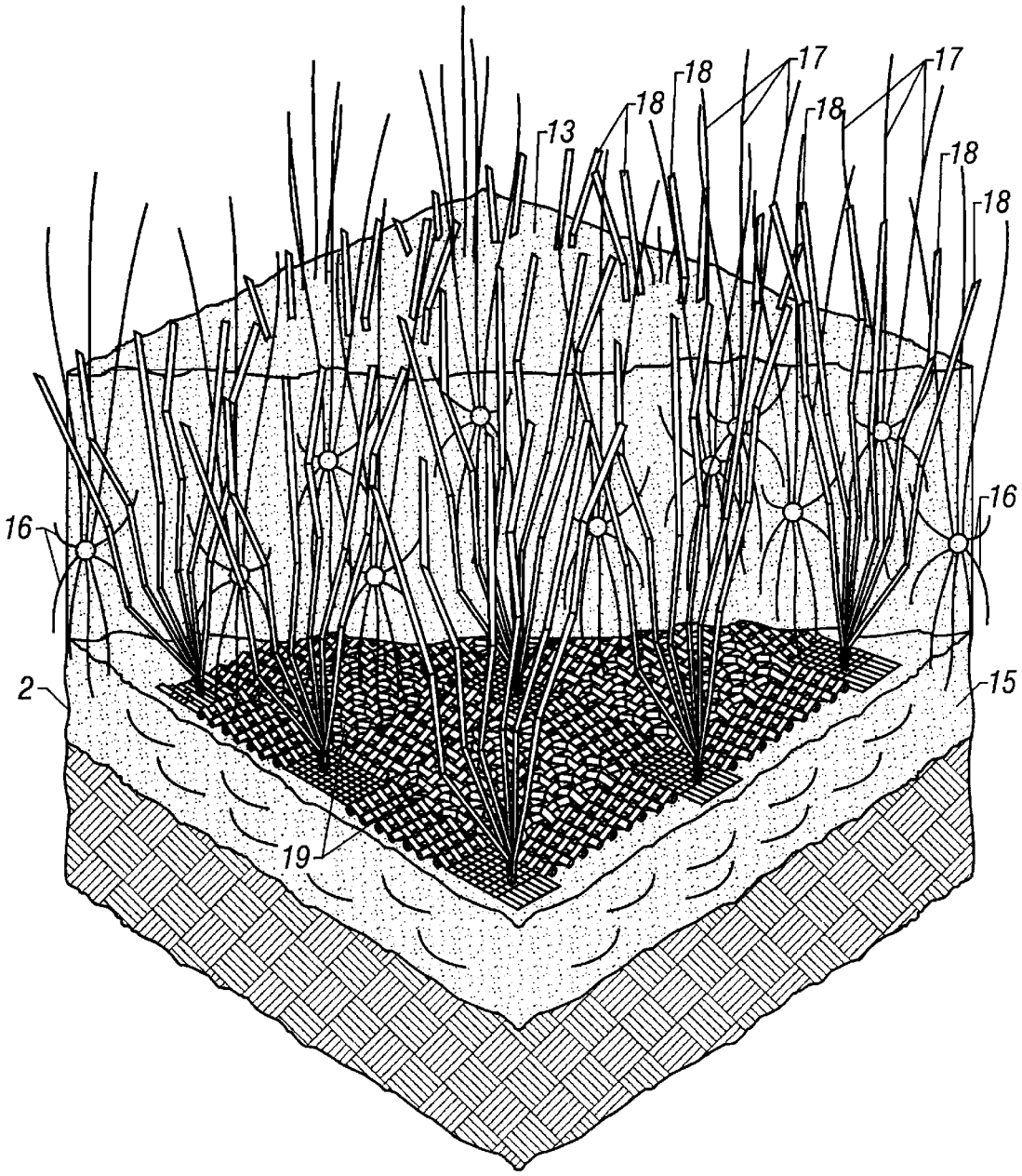
FIG. 4 is a partly broken away perspective detail view of a part of a combined turf according to the invention with a number of adult grass plants.

FIG. 3 shows a first layer of growth substrate 12 onto which base layer 1 is placed. The foundation or substructure for the whole construction is not shown in detail. In a second layer of growth substrate 13 are sown grass seeds 14, only a few of which are shown for the sake of clarity. In the situation shown, the seeds have just germinated. In FIG. 4 the grass plants 15 are adult and their roots 16 extend into the lower layer of growth substrate. The natural grass blades 17 are longer than synthetic grass blades 18. In FIG. 3 the biodegradable threads 5, 6 are still present. In FIG. 4 they have decomposed or have never been present, thereby resulting in apertures 19.

The base layer according to the invention is simple to manufacture and easy to use. The grass surfaces produced therewith moreover have all the advantages of natural grass and synthetic grass, while the most important drawbacks of both are avoided.

The base layer according to the invention preferably has a grid pattern. In such a case, the base layer consists of a fabric of a plurality of series of non-degradable weft threads and a plurality of series of biodegradable weft threads alternating with these series, as well as a plurality of series of non-degradable warp threads intersecting the weft threads and a plurality of series of biodegradable warp threads alternating with these series, and the ends of the synthetic grass fibers protrude from the fabric at locations where the series of non-degradable weft threads and non-degradable warp threads intersect. Relatively robust pieces of fabric thus remain at the intersections of the non-degradable weft and warp threads. In the course of time holes will occur at intersections of biodegradable weft and warp threads. The thus resulting coarse-mesh network is held in place by a layer of growth substrate arranged thereon.

The biodegradable material is for instance jute, coconut fiber, sisal or biodegradable polymers. As additional benefit, many biodegradable threads such as jute and the like have the advantage that they retain moisture well. This is of particular importance, certainly in the initial stages of the development of the turf. Both the biodegradable threads and the non-degradable threads can optionally be impregnated or coated with fertilizers.

It is particularly recommended that the artificial grass fibers are monofilament fibers. In contrast to the fibrillated yarns normally used in synthetic grass surfaces, such monofilament fibers look more like grass blades. If desired however, fibrillated yarns or combinations of different types of yarn can also be used in the base layer according to the present invention.

Synthetic grass fibers are of course usually green. It is however possible according to the present invention for at least a part of the synthetic grass fibers to have at least one colour other than green. A pattern, such as the lines of a playing field or a club logo, can hereby be formed in the synthetic grass part of the combined turf. An advertizing message can also be envisaged here. Fibers with a colour other than green will become particularly clear when the playing field is damaged. Coloured fibers can optionally be used at the location of the pattern which are the same length as the natural grass and planted more densely in the foundation. The pattern is thus also visible when the natural grass is intact. Repeated application of new chalk lines for playing field lines in particular is thus avoided.

In order to promote growth of the natural grass preferably at least part of the fabric of the base layer is impregnated or coated with fertilizers.

For extra strength at least some of the non-degradable threads could be melting threads. During manufacture of the base layer these melting threads can be heated, whereby they fuse together at the intersections of weft and warp threads.

The length of the synthetic grass fibers can be chosen as desired and depends for instance on the distance over which the fiber is co-woven with the fabric and on the thickness of the layer of growth substrate arranged on the base layer as well as on the desired length of the protruding synthetic grass blades.

Synthetic grass fibers are per se known. Synthetic grass fibers are made for instance from polyolefins, polyamides or fibers of natural or non-natural material. The materials used are preferably resistant to wear under mechanical load and to UV radiation. Synthetic grass fibers are obtainable for instance under the brand names THIOLON™, TROFIL™ etc.

The invention also relates to a combined synthetic and natural turf comprising a foundation, a base layer as described above arranged thereon and a layer of growth substrate in which grass plants grow arranged on the base layer. As discussed above, the thickness of the layer of growth substrate arranged on the base layer is preferably chosen such that synthetic grass blades of the base layer remain protruding thereabove. However, in order to achieve the advantages of natural grass it is recommended that the natural grass blades be longer than the synthetic grass blades. These latter then only appear when the natural grass has wholly or partially disappeared due to use or poor weather conditions. In this way the turf will still retain a green appearance, in any case from a distance. In addition, the fibers give the top layer extra stability and protection, whereby intensity of use can be increased.

Also between the foundation and the base layer may be arranged a layer of growth substrate, in which the roots of the grass plants may become anchored.

The foundation can be any foundation used for natural grass or synthetic grass surfaces, such as soil, sand, or a substructure, foundation etc. If desired, shock-absorbing means such as layers of rubber can be applied to a substructure or foundation of for instance concrete. A skilled person in the field of natural and/or synthetic grass surfaces is very well capable, without inventive work, of choosing the foundation suitable for a particular situation. In this application the term "foundation" will be used for any suitable base on which the combined turf according to the invention is used or which forms part of the surface.

The growth substrate can consist for instance of "infertile leaf mould", a mixture of sand and organic material, or of other top layer mixtures applied for natural grass surfaces. Such growth substrates are generally known.

Although a surface manufactured by means of the base layer according to the invention is particularly suitable as sports-field, it can of course also be applied at other locations if desired, for instance in gardens, playgrounds and (recreational) parks, golf courses and the like. Precisely because the turf is in principle a natural grass surface, the applicability thereof is very wide-ranging.

The synthetic grass fibers can be implanted in the base layer according to the invention at a limited density per unit area because the natural grass forms the larger part of the combination turf. However, greater densities are also possible in determined conditions.

The base layer according to the invention can be supplied for instance on a roll and is therefore simple to use. The base layer can be unrolled onto the desired foundation of growth substrate and cut or trimmed to size. No complex installations are required during laying of the turf for insertion of the synthetic grass blades, because the base layer is prefabricated and already contains the synthetic grass blades.

Manufacture of the base layer can also take place in simple manner on a weaving machine. Co-weaving of the synthetic grass fibers is carried out by gripper machines, bar looms or twin looms. Such techniques are generally known.

The invention further provides a method for laying a combined turf according to the invention, comprising the steps of:

a. arranging a base layer as described above on a foundation;

b. arranging a layer of growth substrate and grass seeds sown therein over the base layer, in such manner that the synthetic grass blades rise at least partially above the layer of growth substrate, c. causing the grass seed to germinate and raising grass plants, and d. moving the natural grass to a length which is preferably greater than the length of the synthetic grass blades.

In order to provide a good nutrient medium for the roots of the grass plants, prior to arranging the base layer on the foundation a layer of growth substrate may be arranged thereon.

The step of arranging a layer of growth substrate including grass seeds over the base layer may further comprise the intermediate steps of:

b1. at least partially working or strewing the growth substrate into the base layer, b2. sowing the grass seed into the growth substrate, and b3. arranging the remainder of the growth substrate over the grass seed.

According to the invention the method may therefore include a number of variants. It is thus possible to place the base layer directly onto the foundation or onto a layer of growth substrate arranged on the foundation. Depending on the chosen option, the grass seed can then be sown directly onto the base layer, in a layer of growth substrate arranged on the base layer or on this layer of growth substrate. If desired, combinations can be applied. It is also possible, if desired, to sow in the foundation or the layer of growth substrate under the base layer. This is not recommended however, because the grass seeds will then usually lie too deep.

What is claimed is:

1. A base layer for a combined synthetic and natural turf comprising:

a fabric comprising a grid formed by a plurality of series of substantially parallel non-biodegradeable warp threads intersecting a plurality of series of substantially parallel non-biodegradeable weft threads;

a plurality of apertures, wherein each aperture comprises an enlarged space between adjacent series of the warp and weft threads; and a plurality of synthetic grass fibers, wherein at least one end of each fiber is connected to the fabric at a location where the warp and weft threads intersect.

2. The base layer of claim 1, wherein synthetic grass fibers are woven into the fabric.

3. The base layer of claim 1, wherein synthetic grass fibers comprise monofilament fibers.

4. The base layer of claim 1, wherein some of the synthetic grass fibers comprise a color other than green.

5. The base layer of claim 4, wherein synthetic grass fibers that comprise a color other than green are arranged to form visible lines in the combined turf.

6. The base layer of claim 1, wherein at least part of the fabric is treated with a fertilizer.

7. The base layer of claim 1, further comprising a plurality of substantially parallel biodegradable warp threads and a plurality of substantially parallel biodegradable weft threads, the biodegradeable warp threads alternating with the series of non-biodegradeable warp threads, and the biodegradeable weft threads alternating with the series of non-biodegradeable weft threads.

8. The base layer of claim 7, wherein additional apertures, each aperture comprising an enlarged space, are formed on decomposition of the biodegradable threads.

9. The base layer of claim 1, wherein some of the warp threads and some of the weft threads comprise melting threads.

10. A base layer for a combined synthetic and natural turf comprising:

a fabric comprising alternating series of biodegradable and non-biodegradable warp threads intersecting alternating series of biodegradable and non-biodegradable weft threads, each series comprising a plurality of substantially parallel threads;

a plurality of apertures formed by adjacent series of the intersecting non-biodegradable warp and weft threads and by the series of biodegradable warp and weft threads which intersect within said apertures, each aperture forming an enlarged space between said adjacent series of non-biodegradable warp and weft threads upon decomposition of the biodegradable threads; and a plurality of synthetic grass fibers, wherein at least one end of each fiber is connected to the fabric at a location where non-biodegradable warp and weft threads intersect.

11. The base layer of claim 10, wherein biodegradable threads consist essentially of a material selected from the group consisting of jute, sisal, coconut fiber, and biodegradable polymers.

12. The base layer of claim 10, wherein synthetic grass fibers comprise monofilament fibers.

13. The base layer of claim 10, wherein some of the synthetic grass fibers comprise a color other than green.

14. The base layer of claim 13, wherein synthetic grass fibers that comprise a color other than green are arranged to form visible lines in the combined turf.

15. The base layer of claim 10, wherein at least part of the fabric is treated with a fertilizer.

16. The base layer of claim 10, wherein some of the non-biodegradable warp threads and some of the non-biodegradable weft threads comprise melting threads.

17. A combined synthetic and natural turf comprising:

a foundation;

a base layer positioned above the foundation, the base layer comprising:

a fabric comprising a grid formed by a plurality of series of substantially parallel non-biodegradeable warp threads intersecting a plurality of series of substantially parallel non-biodegradeable weft threads;

a plurality of apertures, wherein each aperture comprises an enlarged space between adjacent series of warp and weft threads; and a plurality of synthetic grass fibers, wherein at least one end of each fiber is connected to the fabric at a location where warp and weft threads intersect; and a layer of growth substrate, in which grass seed is sown, that is positioned on top of the base layer.

18. The combined synthetic and natural turf of claim 17, wherein the growth substrate comprises sand and organic material.

19. The combined synthetic and natural turf of claim 17, further comprising a second layer of growth substrate arranged between the foundation and the base layer.

20. A combined synthetic and natural turf comprising:

a foundation;

a base layer positioned above the foundation, the base layer comprising:

a fabric comprising alternating series of biodegradable and non-biodegradable warp threads intersecting alternating series of biodegradable and non-biodegradable weft threads, each series comprising a plurality of substantially parallel threads;

a plurality of apertures formed by adjacent series of the intersecting non-biodegradable warp and weft threads and by the series of biodegradable warp and weft threads which intersect within said apertures, each aperture forming an enlarged space between said series of non-biodegradable warp and weft threads upon decomposition of the biodegradable threads; and a plurality of synthetic grass fibers, wherein at least one end of each fiber is connected to the fabric at the location where non-biodegradable warp and weft threads intersect; and a layer of growth substrate, in which grass seed is sown, that is positioned on top of the base layer.

21. The combined synthetic and natural turf of claim 20, wherein the layer of growth substrate comprises sand and organic material.

22. The combined synthetic and natural turf of claim 20, further comprising a second layer of growth substrate arranged between the foundation and the base layer.

23. The combined synthetic and natural turf of claim 22, wherein the second layer of growth substrate comprises sand and organic material.

24. A method for creating a combined synthetic and natural turf comprising the steps of:

arranging a base layer over a foundation, the base layer comprising;

a fabric comprising a grid formed by a plurality of series of substantially parallel non-biodegradeable warp threads intersecting a plurality of series of substantially parallel non-biodegradeable weft threads;

a plurality of apertures, wherein each aperture comprises an enlarged space between adjacent series of the warp and weft threads; and a plurality of synthetic grass fibers, wherein at least one end of each fiber is connected to the fabric at a location where warp threads and weft threads intersect arranging a layer of growth substrate, with grass seed sown therein, on top of the base layer in such a manner that synthetic grass fibers of the base layer partially protrude through the layer of growth substrate;

causing the grass seed to germinate and grow grass plants; and mowing the grass plants to approximately the same length as that of the synthetic grass fibers.

25. The method of claim 24, further comprising arranging a second layer of growth substrate between the foundation and the base layer.

26. The method of claim 24, wherein arranging a layer of growth substrate, with grass seed sown therein, on top of the base layer further comprises:

working a first layer of the growth substrate into the base layer;

sowing the grass seed into said growth substrate in the base layer; and arranging a second layer of growth substrate over the grass seed.

27. The method of claim 24, wherein the fabric of the base layer further comprises:

alternating series of biodegradable and non-biodegradable warp threads intersecting alternating series of biodegradable and non-biodegradable weft threads, each series comprising a plurality of substantially parallel threads.

28. The method of claim 27, wherein arranging a layer of growth substrate, with grass seed sown therein, on top of the base layer further comprises:

working a first layer of the growth substrate into the base layer;

sowing the grass seed into said growth substrate in the base layer; and arranging a second layer of growth substrate over the grass seed.

29. The method of claim 28, further comprising arranging a second layer of growth substrate between the foundation and the base layer.

30. The method of claim 24, wherein the base layer further comprises:

a plurality of apertures formed by the series of intersecting non-biodegradable warp and weft threads and by the series of biodegradable warp and weft threads which intersect within said apertures, each aperture forming an enlarged space between said series of non-biodegradable warp and weft threads upon decomposition of the biodegradable threads; and a plurality of synthetic grass fibers, wherein at least one end of each fiber is connected to the fabric at a location where non-biodegradable warp threads and non-biodegradable weft threads intersect.

* * * * *